United States Patent [19]

Kawada et al.

[11] 4,103,451

[45] Aug. 1, 1978

[54] DOLL WITH NECK DETACHABLY SECURED BETWEEN OPPOSED BABY MEANS PORTIONS

[75] Inventors: Chikao Kawada, Tokyo; Toshio Tsuchikura, Koshigaya, both of Japan

[73] Assignee: Chikao Kawada, Japan

[21] Appl. No.: 675,640

[22] Filed: Apr. 9, 1976

[30] Foreign Application Priority Data

| | | | |
|---|---|---|---|
| Apr. 18, 1975 | [JP] | Japan | 50-51994 |
| Apr. 18, 1975 | [JP] | Japan | 50-51995 |
| Apr. 9, 1975 | [JP] | Japan | 50-138003 |
| Apr. 9, 1975 | [JP] | Japan | 50-138004 |
| Apr. 9, 1975 | [JP] | Japan | 50-138005 |
| Apr. 9, 1975 | [JP] | Japan | 50-138006 |

[51] Int. Cl.[2] ..... A63H 3/00

[52] U.S. Cl. ..... 46/22; 46/173; 46/164

[58] Field of Search ..... 46/22, 161, 164, 173

[56] References Cited

U.S. PATENT DOCUMENTS

| | | | |
|---|---|---|---|
| 1,601,447 | 9/1926 | Huck | 46/161 |
| 1,746,839 | 2/1930 | Main et al. | 46/22 |
| 1,868,049 | 7/1932 | Deichmann | 46/161 |
| 2,662,335 | 12/1953 | Calverley | 46/22 |
| 3,273,280 | 9/1966 | Karton | 46/173 X |
| 3,995,395 | 12/1976 | Rahmstorf | 46/22 X |

FOREIGN PATENT DOCUMENTS

| | | | |
|---|---|---|---|
| 138,411 | 7/1934 | Austria | 46/161 |
| 1,506,324 | 11/1967 | France | 46/22 |
| 208,992 | 4/1909 | Fed. Rep. of Germany | 46/173 |
| 369,001 | 2/1923 | Fed. Rep. of Germany | 46/173 |

*Primary Examiner*—F. Barry Shay

*Attorney, Agent, or Firm*—Don B. Finkelstein

[57] ABSTRACT

An articulated toy doll arrangement having a head means, a body means, arm means and leg means, and a neck means interconnecting the head means to the body means, shoulder means interconnecting the arm means to the body means, and hip means interconnecting the leg means to the body means. The mounting of the neck means for interconnecting the head means to the body means is such that at least rotational movement of the head means relative to the body means is provided and, additionally, a nutational movement of the neck means with respect to the body means may also be provided. The arm means is comprised of an upper arm means, a lower arm means and a hand means which may be detachably coupled together for rotational movement about preselected axes. Similarly, the leg means is comprised of an upper leg means, a lower leg means and a foot means which may be detachably coupled together for rotational movement about preselected axes. The hip means and/or the shoulder means are mounted on the body means for rotational movement about preselected axes and the mounting may be a detachable mounting. The body means may be comprised of one member or a plurality of detachably interconnected members.

28 Claims, 22 Drawing Figures

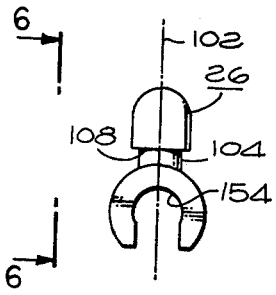
FIG. 5
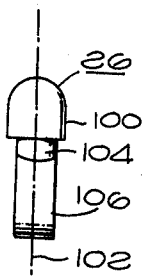
FIG. 6
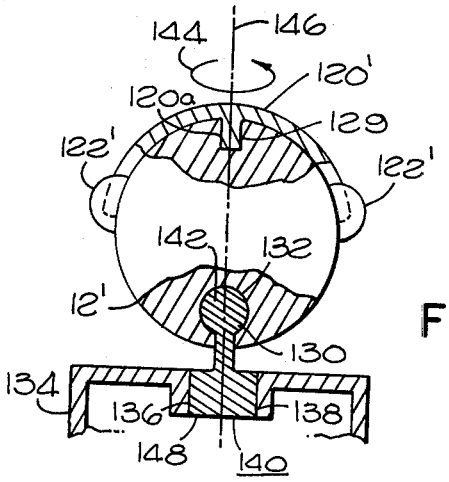
FIG. 8
FIG. 7
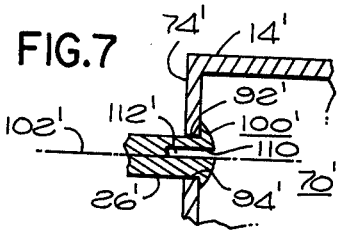
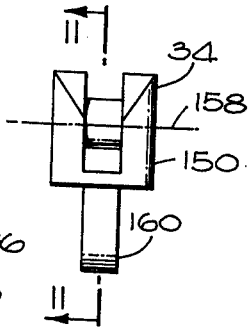
FIG. 9
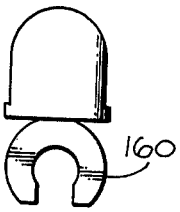
FIG. 10
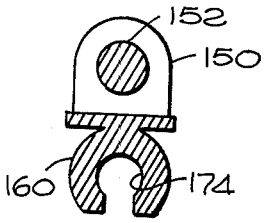
FIG. 11
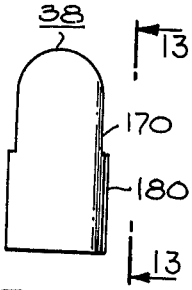
FIG. 12
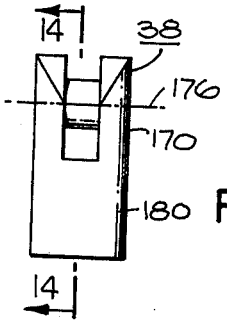
FIG. 13
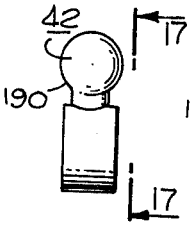
FIG. 16
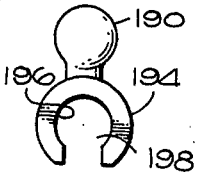
FIG. 17
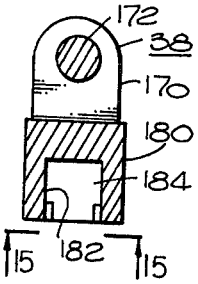
FIG. 14
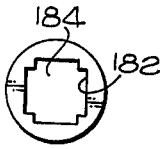
FIG. 15
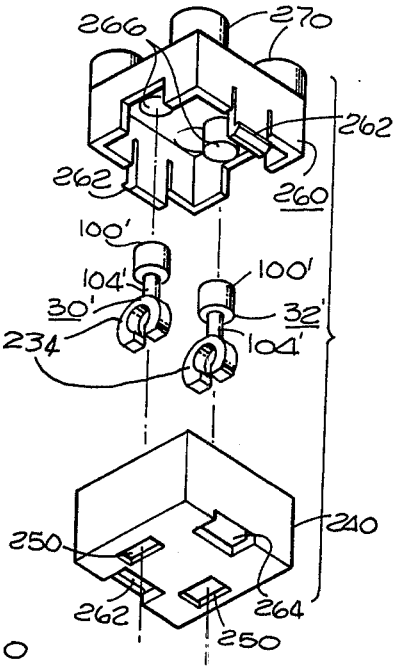
FIG. 21
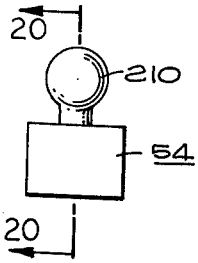
FIG. 19
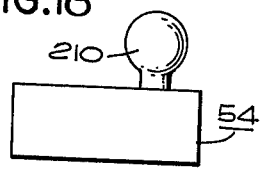
FIG. 18
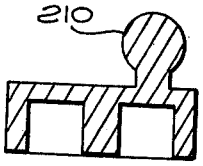
FIG. 20
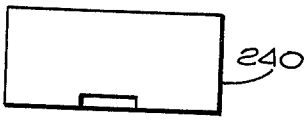
FIG. 22

DOLL WITH NECK DETACHABLY SECURED BETWEEN OPPOSED BABY MEANS PORTIONS

BACKGROUND OF THE INVENTION

Field of the Invention

This invention relates to the toy art and more particularly to an articulated doll arrangement having generally anthropomorphically movable parts as well as other types of movable connections therebetween.

Description of the Prior Art

Toys in the form of dolls are one of the oldest known types of toys. Such dolls in the form of humans or animals have been utilized for centuries not only as toys for the amusement and or education of children but also in many mystical and/or semi-religious activities.

Articulated dolls, that is, dolls having portions thereof movable with respect to each other have also long been known and long utilized. Further, articulated dolls having anthropomorphic movement, i.e., movement simulating the movement of the various portions of the human and/or animal anatomy which the doll simulates, have also long been known and such articulated dolls provide, when utilized as toys, even greater enjoyment and pleasure for children since the various positions of the body known to them can be simulated in the doll. Such simulation, of course, enhances the play value of such toys as well as aiding in the development of manual dexterity of the children.

In addition to amphropomorphic movement in such dolls, it has also been found that additional movements, which may not necessarily correspond to allowable movement of the actual entity which the doll simulates, increases the play value of the doll. Such additional movements may comprise, for example, the ability to rotate a head 360° with respect to the body. While such movements of the head or other portions of the anatomy in such dolls are often termed "silly" movements, it has been found that children, in the learning stages, find a greatly enhanced play value when such movements can be achieved.

Further, the ability to join together and/or disassemble some or all of the components making up the doll has also been found to enhance the play value by allowing the child to utilize imagination in combining various portions of the doll in various interesting and/or amusing combinations. Such detacable coupling of the components of the doll further aids in the development of the manual dexterity of the child.

SUMMARY OF THE INVENTION

Accordingly, it is an object of this invention to provide an improved articulated doll arrangement.

It is another object of the present invention to provide an articulated doll arrangement having at least some anthropomorphic moveability characteristics associated with the components thereof.

It is yet another object of the present invention to provide an improved articulated doll having movement capabilities not associated with the actual figure which the doll represents.

It is yet a further object of the present invention to provide an improved articulated doll arrangement having a high degree of play value and capable of comparatively easy assembly and disassembly of at least some of the components thereof.

The above, and other, objects are achieved, according to the preferred embodiments of the present invention, by providing an articulated doll comprised of a head means, body means, a pair of arm means, and a pair of leg means. A neck means is utilized to interconnect the head means to the body means and the neck means may be coupled to the body means to allow pivotal motion of the head means with respect to the body means or, in certain embodiments of the present invention, the neck means may be movably mounted in the body means for nutational movement to simulate more nearly the actual movement of the neck.

It will be appreciated, of course, that while the description of the preferred embodiments of the present invention as set forth herein illustrate the applications of the principles thereof in dolls simulating the human form, such illustrative examples are not limiting to the present invention. That is, the principles may also be utilized in dolls simulating other types of animals as may be desired.

A shoulder means is connected to the body means for interconnecting the pair of arms means thereto. Each arm means has an upper arm means, a lower arm means and a hand means. The shoulder means allows rotational movement of the entire arm means with respect to the body means and the connection of the upper arm means to the shoulder means provides a pivotal and/or rotational movement thereof about an axis substantially perpendicular to the axis of rotation of the shoulder means. The lower arm means is pivotally mounted on the upper means for pivotal or rotational movement thereof and the hand means is mounted for movement on the lower arm means. The movement of the hand means with respect to the lower arm means may be a ball and socket type of movement with the hand means having the ball thereof and the lower arm means having the socket thereof.

The leg means may be fabricated substantially similarly to the arm means and provided with a hip means mounted in the body means for rotational movement with respect therewith and an upper leg means movably mounted on the hip means for rotational movement about an axis substantially perpendicular to the axis of rotation of the hip means. The upper leg means may be substantially similar to the upper arm means.

A lower leg means is rotatably mounted on the upper leg means for movement about a predetermined axis substantially parallel to the axis of movement of the upper leg means and a foot means may be coupled to a lower portion of the lower leg means by, for example, a ball and socket type of connection with the foot means having the ball portion thereof and the lower leg means having the socket portion thereof.

The shoulder means and hip means may, if desired, be detachably mounted into the body means.

The body means may be fabricated from a single member or, in preferred embodiments of the present invention, may be fabricated from a plurality of detachably mounted portions to allow assembly and disassembly thereof. Further, in preferred embodiments of the present invention wherein the body means is comprised of a plurality of detachably coupled portions, at least some of the detachably coupled portions may be in the form of a building block compatible with the building blocks supplied in certain building block sets such as the very popular and universally acclaimed LOC BLOC building block sets, a trademark of ENTEX Industries, Inc., Carson, California, and/or the corresponding DIABLOCK of KAWADA Company, Ltd., Tokyo, Japan.

BRIEF DESCRIPTION OF THE DRAWINGS

The above and other embodiments of the present invention may be more fully understood from the following detailed description taken together with the accompanying drawings wherein similar reference characters refer to similar elements throughout and in which:

FIGS. 5 and 6 illustrate the structure of a shoulder means and a hip means useful in the practice of the present invention;

FIG. 7 illustrates another embodiment of the present invention;

FIG. 8 illustrates another embodiment of the present invention;

FIGS. 9, 10, and 11 illustrate the upper arm and upper leg structure useful in the practice of the present invention;

FIGS. 12, 13, 14, and 15 illustrate the structure associated with the lower arm and lower leg of the present invention;

FIGS. 16 and 17 illustrate the structure of a hand means useful in the practice of the present invention;

FIGS. 18, 19, and 20 illustrate the structure associated with the foot means useful in the practice of the present invention;

FIG. 21 is an exploded view showing the interconnection between the bottom portion of the body means and the hip means of the present invention; and FIG. 22 illustrates the embodiment shown in FIG. 21.

DESCRIPTION OF THE PREFERRED EMBODIMENTS

Figure 1:
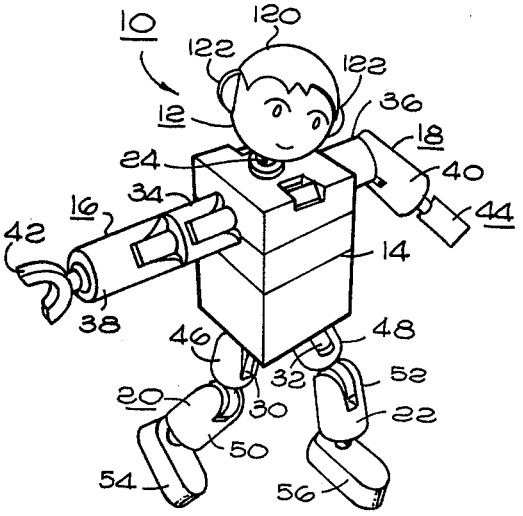
FIG. 1 is a perspective view of an articulated doll according to the principles of the present invention.

Referring now to FIG. 1 there is illustrated a preferred embodiment of the present invention. As noted above, the drawings herein illustrate the principles of the present invention in an articulated doll arrangement simulating the human form. It will be appreciated, of course, that the invention is not so limited and the principles of the present invention may equally well be utilized in dolls simulating any other desired animal. Those skilled in the art will recognize the minor changes and/or modifications necessary from the structure shown to achieve articulated dolls in the form of such other animals.

In the embodiment 10 shown on FIG. 1, the articulated doll arrangement generally comprises a head means 12, a body means generally designated 14, a pair of arm means 16 and 18, and a pair of leg means 20 and 22. In preferred embodiments of the present invention, each of the arm means 16 and 18 are substantially identical and each of the leg means 20 and 22 are substantially identical. Further, and as discussed below in greater detail, many portions of the arm means and leg means may be substantially identical. The head means 12 is connected to the body means 14 by a neck means 24. Each of the arm means 16 and 18 are coupled to the body means 14 by a shoulder means 26 and 28 (shoulder means 28 for connecting arm means 18 not being visible in FIG. 1). Each of the leg means 20 and 22 are coupled to the body means 14 by hip means 30 and 32. In preferred embodiments of the present invention each of the shoulder means 26 and 28 are substantially identical and are substantially identical to each of the hip means 30 and 32.

Each of the arm means 16 and 18 are comprised of an upper portion 34 and 36, respectively, a lower arm portion 38 and 40, respectively, and hand means 42 and 44, respectively. Each of the upper arm means 34 and 36 are substantially identical and each of the lower arm means 38 and 40 are substantially identical and each of the hand means 42 and 44 are substantially identical.

Each of leg means 20 and 22 are comprised of an upper leg means 46 and 48, respectively, a lower leg means 50 and 52, respectively, and foot means 54 and 56, respectively.

Figure 2:
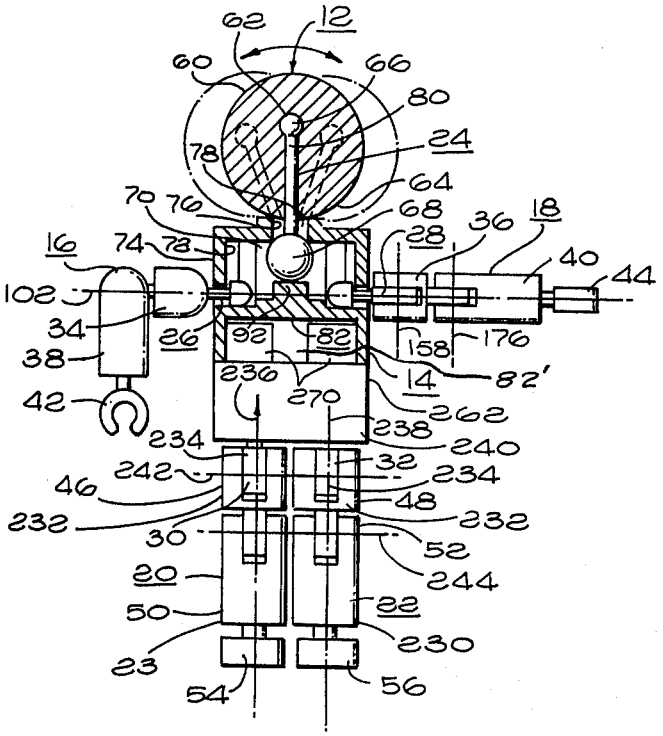
FIG. 2 is a sectional view thereof.

As shown in FIG. 2, the head means 12 is provided with first walls 60 defining a neck receiving aperture 62 therein extending from the lower portion 64 thereof a preselected depth into the head means 12. The neck means 24 is comprised of an upper knob portion 66 frictionally retained in the matching aperture 62 of the head means 12 and a lower knob portion 68 retained in a cavity 70 defined by internal wall 72 in an upper portion 74 of the body means 14. The upper portion 74 of the body means 14 is also provided with walls 76 defining a neck receiving aperture 78 therein communicating with the internal cavity 70. An intermediate portion 80 of the neck means 24 interconnects the upper knob portion 66 with the lower knob portion 68 and extends through the neck aperture 76 in the upper portion 74 of the body means 14. An intermediate body portion 82 is detachably coupled to the upper body portion 74 by tab means 84 resiliently retained in apertures 86 of the upper body portion 74. This is shown most clearly in FIG. 4.

Figure 3:
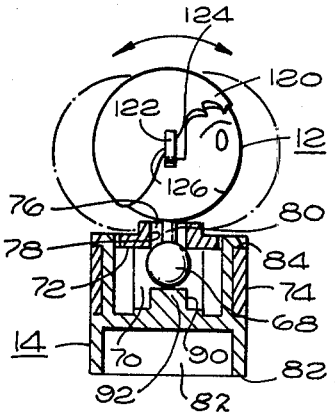
FIG. 3 is another sectional view thereof.

The intermediate body portion 82 is also provided with walls 90 defining a support portion 92 that bears against the lower knob 68 of the neck means 24 in the upper portion internal cavity 70. The upper body portion 74 and intermediate body portion 82 are fabricated, in preferred embodiments of the present invention, so that the lower knob 68 of the neck means 24 also bears against the internal walls of the upper portion 74 along the base of the neck aperture 76 when it is supported by the support portion 92 of the intermediate body portion 82. The size of the neck aperture 76 is larger than the size of the connecting portion 80 to allow the neck means 24 to have approximately nutational movement with respect to the body means 14. This is illustrated clearly by the phantom line showing in FIGS. 2 and 3. Thus, the neck means 24 allows movement closely approaching anthropomorphic movement of the head means 12 with respect to the body means 14 due to the approximately nutational movement. Additionally, the head means 12 may rotate 360° about a vertical axis to provide the additional type of movement which, while not completely anthropomorphic, can provide additional play value by allowing the head means 12 to assume positions with respect to the body means 14 that are not found in the human body. The rotational movement may be of the head means 12 on the neck means 24 or, alternatively, or in addition thereto, may be the head means 12 and neck means 24 rotating about the point of contact between the lower knob portion 68 with the support 92.

As noted, the arm means 16 and 18 are interconnected to the body means 14 by the shoulder means 26 and 28, respectively. In the embodiment shown in FIGS. 1, 2, 3, and 4, the upper body portion 74 is provided with shoulder walls 92 defining shoulder receiving aperture 94 therethrough which are substantially aligned and at right angles to the neck aperture 76. Matching apertures 96 may also be provided in the intermediate body portion 82 which are aligned with the aperture 94.

The shoulder apertures 94 and apertures 96 communicate with the internal cavity 70.

As shown most clearly in FIGS. 5 and 6, each of the shoulder means 26 and 28, which, in preferred embodiments of the present invention are substantially identical, are comprised of an internal portion 100 mounted in the internal cavity 70 of the upper body portion 74 for rotational movement about a shoulder axis 102. A shoulder connecting portion 104 is provided for interconnecting the internal portion 100 with a joining portion 106. The connecting portion 104 extends through the shoulder apertures 94 in the upper body portion 74. As can be seen from FIGS. 5 and 6, the internal portion 100 of the shoulder means 26 and 28 are enlarged and the abutting surface 108 thereof engages the internal walls 72 of the upper body portion 74 and, if desired, extend partially into the apertures 96 of the intermediate body portion 82.

Figure 4:
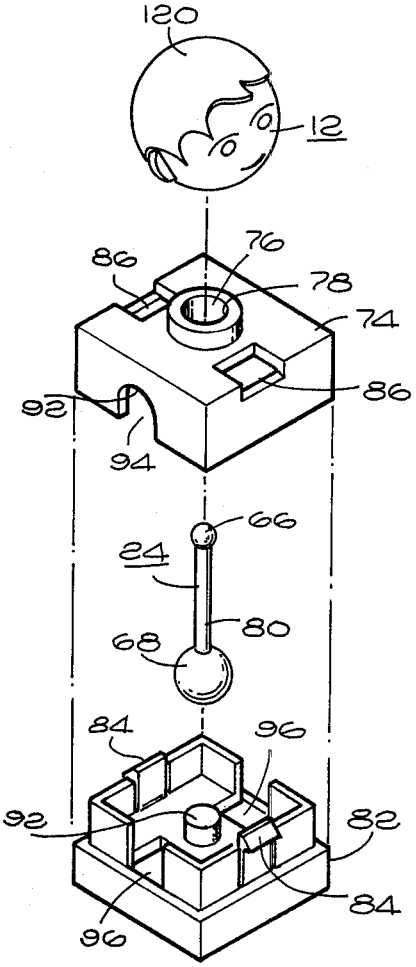
FIG. 4 is an exploded view showing the interconnection between the head means, body means, and neck means of the present invention.

As shown in FIG. 4, the assembly of the head means 12, body means 14, neck means 24 and shoulder means 26 and 28 may be accomplished in the following manner. The neck means 24 is inserted through the neck aperture 76 in the upper body portion 74 of the body means 14. The shoulder means 26 and 28 are aligned in the apertures 94 and the intermediate body portion 82 is mounted on the upper body portion 74 by means of the deformable resilient members 84. This clamps the supporting surface 92 against the lower knob 68 of the neck means 24 and also retains the shoulder means 26 and 28 in the apertures 94. The head means 12 may then be inserted on the neck means 24.

In other embodiments of the present invention, it may be desirable to provide the shoulder means 26 and 28 detachably mounted in the upper body portion 74 of the body means 14. FIG. 7 illustrates an arrangement for providing such detachable coupling. As shown in FIG. 7 the body means 14' is comprised of an upper body portion 74' having shoulder walls 92' defining a shoulder aperture 94' therethrough. The shoulder means 26' is provided with an internal portion 100' having walls 110 defining a slot 112 therein and the slot 112 is substantially aligned along the shoulder axis 102'. The slot 112 allows deformation of the shoulder means 26' to allow the enlarged internal portion 100' to pass through the shoulder aperture 94' and be retained in the cavity 70' of the upper body portion 74'. Similarly, to remove the shoulder means 26', the shoulder means 26' is pressed together along the aperture 112 and the internal portion 100' may be removed through the shoulder aperture 94'. As described below in greater detail, the structure of the hip means 30 and 32 may be substantially identical to the shoulder means 26 and 28 or the shoulder means 26' shown in FIG. 7.

Thus, the shoulder means 26 and 28 and/or the shoulder means 26' described above provides for not only anthropomorphic movements simulating the rotational aspects of the shoulder joint of the human body but also additional movement to allow full 360° rotation thereof.

A hair piece 120 may be provided and may be mounted on the head means 12. The head means 12 may be provided with outwardly extending ear means 122 and the hair piece 120 may be provided with walls 124 defining a slot 126 therein for frictionally engaging the ear means 122 to retain the hair piece 120 on the head means 12.

Additionally, in order to provide further retention capabilities of the hair piece 120 on the head means 12, the hair piece 120 may be provided with a projecting portion **120*a*, as shown on FIG. 8, extending into an aperture 129 on the head means 12 which may be diametrically aligned with the neck aperture 76**.

FIG. 8 illustrates an alternative embodiment for interconnecting the head means to the body means. As shown in FIG. 8, the head means 12' which may be generally similar to the head means 12 described above and be provided with walls 130 defining a neck aperture 132 therein. The body means 134 is provided with walls 136 defining a neck aperture 138 therein which may be similar to the neck aperture 76 described above. However, in the embodiment 129 shown in FIG. 8, the neck means 140 has an upper knob portion 142 positioned in the neck aperture 132 of the head means 12' for relative rotational movement in the direction indicated by the arrow 144 about the vertical axis 146. A lower knob portion 148 of the neck means 140 is fixedly coupled in the neck aperture 138 of the body means 134 by, for example, gluing, electronic sealing, or the like. Thus, in the embodiment 129 shown in FIG. 8, the head means 12' only rotates and does not nutate as is the case with the embodiment 10 described above.

FIGS. 9, 10, and 11 illustrate the upper arm means 34 and 36 which, as noted above, may also be similar to the upper leg means 46 and 48. The upper arm means 34 may be substantially identical to the upper arm means 36 and the upper leg means 46 may be substantially identical to the upper leg means 48. As shown in FIGS. 9, 10, and 11, the upper arm means has an upper connecting portion 150 which is detachably mounted by pin means 152 in the pin receiving means 154 of the shoulder connecting portion 106. As shown in FIG. 5, the shoulder connecting portion 106 is resiliently deformable to allow insertion of the pin means 152 into the pin receiving means 154. When so mounted, the upper arm means 150 is allowed rotational movement about an axis 158 which is substantially perpendicular to the shoulder axis 102. The upper arm means 34 is also provided with an elbow portion 160 and, as shown, the elbow portion 160 is generally similar to the shoulder connecting portion 106 described above.

FIGS. 12, 13, 14, and 15 illustrate the lower arm means 38 and 40 which, as noted above, in preferred embodiments of the present invention, is substantially identical to the lower leg means 50 and 52 and the components are substantially identical to each other. The lower arm means 38 has an upper conncecting portion 170 which is provided with a pin means 172 preferably detachably mounted in a pin receiving means 174 of the elbow portion 160 of the upper arm means 34. This connection is substantially similar to the connection of the upper arm means 34 to the shoulder means 26 described above. The pin connection by means of the pin 172 with the elbow portion 160 of the upper arm means 34 allows rotation about an elbow axis 176 that, as shown in FIG. 2 may be substantially parallel to the axis 158 when the arm means 18 is so aligned. However, because of the rotational movement allowed between the upper arm and lower arm means and between the upper arm means and the shoulder means, the elbow axis 176 will always lie in a plane that is parallel to the axis 158 and such planes will be substantially perpendicular to the shoulder axis 102. The lower arm means 38 is also provided with a wrist portion 180 that is spaced from the upper connecting portion 170 and is provided with walls 182 defining a knob receiving aperture 184 therein.

FIGS. 16 and 17 illustrate the hand means 42 and 44 utilized in preferred embodiments of the present invention. The hand means 42 has an upper connecting portion 190 which is detachably mountable in the aperture 184 of the lower arm means 38. As shown, the interconnection between the hand means 42 and the lower arm means 38 provides, essentially, a ball and socket movement with the portion 190 of the hand means 42 comprising the ball and the aperture 184 of the lower arm means 38 comprising the socket. Resilient deformation of the walls 182 in the wrist portion 180 of the lower arm means 38 allows insertion of the connecting portion 190 therein to provide the above described ball and socket type movement. The hand means 42 is also provided an external portion 194 which, as illustrated in FIG. 17, may be provided with walls 196 defining an aperture 198 generally similar to the apertures provided in the upper and lower arm portion. This allows insertion of other devices (not shown) therein to enhance and increase the play value of the dolls.

FIGS. 18, 19, and 20 illustrate the foot means 54 which may be utilized in the preferred embodiments of the present invention. The foot means 54 is provided with an upper connecting portion 210 which may be generally similar to the upper connecting portion 190 utilized on the hand means 42 described above. Thus, the foot portions 54 and 56 are mounted on the lower leg portions 50 and 52, respectively, by a ball and socket type of interconnection therebetween similar to the connection between the hand means 42 and 44 with the lower arm means 38 and 40, respectively, described above.

As discussed above, each of the leg means 20 and 22 are substantially identical to the arm means 16 and 18. However, for convenience, the various portions of each of the components of the leg means 20 and 22 are described as having the components associated with legs rather than arms. That is, the lower leg means 50 and 52 have ankle portions 230 which are similar to the wrist portions 180 described above. The upper leg means 46 and 48 have knee portions 232 which may be similar to the elbow portions 160 described above. The hip means 30 and 32 have joining portions 234 which may be similar to the shoulder joining portions 106 described above. Each of the leg means 20 and 22 are rotatably mounted on the body means 14 for rotation about leg axis 236 and 238, respectively, in a lower portion 240 of the body means 14. The upper leg portions 46 and 48 are rotatably mounted in the hip portions 30 and 32, respectively, for rotation about a hip axis 242 and the lower leg portions 50 and 52 are rotatably mounted in the upper leg portions 46 and 48 for rotation a knee axis 244 which is in a plane substantially parallel to the plane containing the hip axis 232 and perpendicular to the leg axis 236 and 238. The leg axis 236 and 238 lie in substantially parallel planes.

FIG. 21 illustrates a preferred arrangement for interconnecting the lower portion 240 of the body means 14 with the upper portion 74 thereof and the positioning of the hip means 30' and 32' therein which are substantially similar to the shoulder means 26 and 28 shown in FIGS. 5 and 6, except that the internal portion 100' of hip means 30' and 32' are generally cylindrical. As shown in FIG. 21, the lower portion 240 is provided with a pair of apertures 250 for receiving the hip means 30 and 32 therethrough. The lower portion 240 is substantially hollow and defining a lower portion cavity therein. The internal portions 100' of the hip means 30' and 32' are retained in the lower portion cavity and the hip joining portions 106 are external the lower portion 240. The connecting portions 104' are positioned in the apertures 250 for rotational movement therein about the leg axis 236 and 238. A lower intermediate portion 260 is utilized for interconnecting the lower portion 240 with the intermediate portion 82. The lower intermediate portion 260 has tabs 262 similar to the tabs 84 described above which are adapted to fit into the tab receiving apertures 264 in the lower portion 240 for frictional retention therein. The lower intermediate portion 260 is also provided with support surfaces 266 which, for the condition of the lower intermediate portion 262 interengaged with the lower portion 240 bears against the upper surfaces of the internal portions 100' of the hip means 30' and 32' to retain them in the apertures 250. Protruding members 270 oppositely disposed from the support surfaces 266 are frictionally retained in the cavity 82' of the intermediate portion 82 for detachable coupling therebetween. The manner of coupling of the intermediate portion 82 with the lower intermediate portion 262 is similar to that in the universally popular LOC BLOC or DIABLOC as mentioned above. It will be appreciated, of course, that a plurality of other intermediate portions (not shown) may be inserted between the intermediate portion 82 and lower intermediate portion 262 to provide any desired degree of elongation of the body means 14 for additional play and amusement value.

This concludes the description of the improved articulated doll arrangement according to the principles of the present invention. As discussed above, it can be seen that not only may anthropomorphic movements of the doll be provided according to the teachings, but also additional movements for enhanced play and amusement value. Those skilled in the art may find many variations and adaptations of the present invention and all such variations and adaptations are intended to fall within the true scope and spirit of the appended claims.

We claim:

1. In an articulated doll arrangement of the type having a head means, a body means and a neck means interconnecting said head means to said body means, the improvement comprising, in combination:

said neck means comprising:

an upper knob portion, a lower knob portion, and an intermediate portion extending between said upper knob portion and said lower knob portions; and said body means including means for detachably connecting said lower knob portion of said neck means to said body means comprising: a planar surface in a portion of said body means bearing against said lower knob portion of said neck means, neck walls in another portion of said body means defining a neck aperture, and said neck walls engaging said lower knob portion of said neck means in opposed spaced relationship to said planar surface, and said intermediate portion of said neck means extending with clearance through said neck aperture to provide nutational movement of said neck means with respect to said body means.

2. The arrangement defined in claim 1 wherein: said head means comprising:

first walls defining a neck aperture extending a predetermined distance therein from regions adjacent a bottom portion thereof;

said neck means further comprising: said upper knob portion mounted in said neck aperture in said head means for relative rotational motion therebetween;

said upper and said lower knob portions being substantially spherical;

said planar surface and said neck walls of said body means frictionally and movably clamp said lower knob portion of said neck means therebetween; and said neck aperture of said body means is larger than said intermediate portion of said neck means.

3. The arrangement defined in claim 2 wherein:

said head means further comprises:

a generally spherical member; and second walls defining a second aperture therein in regions adjacent a top portion thereof substantially diametrically opposed to said first aperture;

and further comprising:

a hairpiece means mounted on said head means and having a projecting portion extending into said second aperture for frictional retention therein.

4. The arrangement defined in claim 3 wherein:

said head means further comprises:

a pair of diametrically opposed ear means extending outwardly therefrom and aligned substantially along a diameter at substantially right angles to said diameter between said first and said second apertures;

said hair piece means further comprises:

walls defining slot means for frictionally engaging said ear means.

5. In an articulated doll arrangement of the type having a head means, a body means and a neck means interconnecting said head means to said body means, the improvement comprising, in combination:

said head means comprising:

first walls defining a neck aperture extending a predetermined distance therein from regions adjacent a bottom portion thereof;

said neck means comprising:

an upper knob portion mounted in said neck aperture in said head means;

a lower knob portion spaced from said upper knob portion;

a connecting portion interconnecting said upper knob portion and said lower knob portion;

said body means comprising:

means for detachably securing said lower knob thereto including an upper portion of said body means; having neck walls defining a neck aperture therethrough, and said connecting portion of said neck means movably mounted in and extending through said neck aperture, and said connecting portion of said neck means having a predetermined clearance from said neck walls to allow relative nutational movement between said neck means and said upper portion of said body means, and said neck walls engaging said lower knob portion of said neck means in substantially line contact; and said means for detachably securing further comprising:

another portion of said body means having a planar surface engaging said lower knob portion of said neck means in substantially point contact in spaced opposed relationship to said neck walls for frictionally, movably retaining said lower knob portion therebetween.

6. The arrangement defined in claim 5 wherein:

said lower knob portion of said neck means is generally spherical;

said body means further comprises:

internal walls in said upper portion of said body means defining an internal cavity therein communicating with said neck aperture thereof, and said lower knob portion of said neck means positioned in said internal cavity; and said planar surface being positioned in said internal cavity of said upper portion of said body means.

7. The arrangement defined in claim 6 wherein:

said head means further comprises:

a generally spherical member;

a pair of substantially diametrically opposed ear means extending outwardly therefrom along a diameter at substantially right angles to said neck receiving aperture therein;

and further comprising;

a hair piece means frictionally mounted on said head means and said hair piece means having walls defining slot means therein for frictionally engaging said ear means for retention of said hair piece means on said head means.

8. The arrangement defined in claim 5 wherein: said upper portion of said body means further comprises:

internal walls defining an internal cavity therein communicating with said neck receiving aperture thereof; said neck means further comprises:

said lower knob portion of said neck means being substantially spherical and movably mounted in said internal cavity for said relative nutuational movement between said neck means and said body means;

said body means further comprises: said planar surface being positioned in said internal cavity of said upper portion of said body means;

and said upper portion of said body means further comprising:

shoulder walls defining a pair of opposed shoulder apertures therein communicating with said internal cavity;

a pair of shoulder means, each shoulder means having; an internal portion mounted in said cavity of said upper portion of said body means for rotational movement thereof about a shoulder axis;

a shoulder joining portion external to said upper portion of said body means; and a connecting portion between said internal portion and said shoulder joining portion, said connecting portion extending through one of said pair of shoulder apertures in said upper portion of said body means.

9. The arrangement defined in claim 8 and further comprising:

a pair of upper arm means, each upper arm means having an upper connecting portion detachably mounted in one of said shoulder joining portions of said shoulder means for rotational movement thereon about an arm axis substantially perpendicular to said shoulder axis, and an elbow portion spaced from said upper connecting portion.

10. The arrangement defined in claim 9 and further comprising:

a pair of lower arm means, each lower arm means having an upper connecting portion detachably mounted in said elbow portion of one of said upper arm means for rotational movement about an elbow axis substantially parallel to said arm axis, and a wrist portion spaced from said upper connecting portion of said lower arm means.

11. The arrangement defined in claim 10 and further comprising:

a pair of hand means, each hand means having an upper connecting portion detachably mounted in said wrist portion of one of said lower arm means for relative movement therebetween.

12. The arrangement defined in claim 11 wherein:

said relative movement between said hand means and said lower arm means comprises a ball and socket movement, and said upper connecting portion of said hand means comprising said ball thereof and said wrist portion of said lower arm means comprising said socket thereof.

13. The arrangement defined in claim 5 wherein:

said upper portion of said body means further comprises: internal walls defining an internal cavity therein communicating with said neck receiving aperture thereof; said neck means further comprises: said lower knob on said lower portion of said neck means is substantially spherical and movably mounted in said internal cavity for said relative nutational movement between said neck means and said body means:

said body means further comprises:

said planar surface being positioned in said internal cavity of said upper portion of said body means;

said body means further comprises:

a lower portion coupled to said another portion; walls defining a first pair of hip receiving apertures in said lower portion of said body means; and lower portion internal walls defining a lower portion cavity in said lower portion of said body means, and said first pair of hip receiving apertures in said lower portion communicating with said lower portion cavity;

a pair of hip means, each hip means having an internal portion mounted in said lower portion cavity of said lower portion of said body means for rotational movement therein about a hip axis, and a hip joining portion external to said lower portion of said body means, and a connecting portion between said internal portion and said joining portion of said hip means, and said connecting portion extending through one of said hip receiving apertures in said lower portion of said body means.

14. The arrangement defined in claim 13 and further comprising:

a pair of upper leg means, each upper leg means having an upper connecting portion detachably mounted in one of said hip joining portions of said hip means for rotational movement thereon about a leg axis substantially perpendicular to said hip axis, and a knee portion spaced from said upper connecting portion.

15. The arrangement defined in claim 14 and further comprising:

a pair of lower leg means, each lower leg means having an upper connecting portion detachably mounted in said knee portion of one of said upper leg means for rotational movement about a knee axis substantially parallel to said leg axis, and an ankle portion spaced from said upper connecting portion of said lower leg means.

16. The arrangement defined in claim 15 and further comprising:

a pair of foot means, each foot means having an upper connecting portion detachably mounted in said ankle portion of one of said lower leg means for relative movement therebetween.

17. The arrangement defined in claim 16 wherein:

said relative movement between said foot means and said lower leg means comprises a ball and socket movement, said upper connecting portion of said foot means comprising said ball thereof and said ankle portion of said lower leg means comprising the socket thereof.

18. The arrangement defined in claim 5 wherein:

said upper portion of said body means further comprises: internal walls defining an internal cavity therein communicating with said neck receiving aperture thereof; said neck means further comprises:

said lower knob on said lower portion of said neck means being substantially spherical and movably mounted in said internal cavity for said relative nutational movement between said neck means and said body means; said body means further comprises:

said planar surface being positioned in said internal cavity of said upper portion of said body means; and said upper portion of said body means further comprising: shoulder walls defining a pair of opposed shoulder apertures therein communicating with said internal cavity; a pair of shoulder means, each shoulder means having: an internal portion mounted in said cavity of said upper portion of said body means for rotational movement thereof about a shoulder axis;

a shoulder joining portion external to said upper portion of said body means; and a connecting portion between said internal portion and said shoulder joining portions, said connecting portion extending through one of said pair of shoulder apertures in said upper portion of said body means; said body means further comprises:

a lower portion coupled to said another portion; hip walls defining a first pair of hip receiving apertures in said lower portion of said body means; and lower portion internal walls defining a lower portion cavity in said lower portion of said body means, and said first pair of hip receiving apertures in said lower portion communicating with said lower portion cavity; a pair of hip means, each hip means having an internal portion mounted in said lower portion cavity of said lower portion of said body means for rotational movement therein about a hip axis, and a hip joining portion external to said lower portion of said body means, and a connecting portion between said internal portion and said joining portion of said hip means, and said connecting portion extending through one of said hip receiving apertures in said lower portion of said body means.

19. The arrangement defined in claim 18 wherein each of said pair of shoulder means and each of said pair of hip means are substantially identical to each other.

20. The arrangement defined in claim 18 and further comprising:

a pair of upper arm means, each upper arm means having an upper connecting portion detachably mounted in one of said shoulder joining portions of said shoulder means for rotational movement thereon about an arm axis substantially perpendicular to said shoulder axis, and an elbow portion spaced from said upper connecting portion:

a pair of upper leg means, each upper leg means having an upper connecting portion detachably mounted in one of said hip joining portions of said hip means for rotational movement thereon about a leg axis substantially perpendicular to said hip axis, and a knee portion spaced from said upper connecting portion of said upper legg means.

21. The arrangement defined in claim 20 wherein each of said pair of upper arm means and each of said pair of upper leg means are substantially identical to each other.

22. The arrangement defined in claim 20 and further comprising:

a pair of lower arm means, each lower arm means having an upper connecting portion detachably mounted in said elbow portion of one of said upper arm means for rotational movement about an elbow axis substantially parallel to said arm axis, and a wrist portion spaced from said upper connecting portion of said lower arm means;

a pair of lower leg means, each lower leg means having an upper connecting portion detachably mounted in said knee portion of one of said upper leg means for rotational movement about a knee axis substantially parallel to said leg axis, and an ankle portion spaced from said upper connecting portion of said lower leg means.

23. The arrangement defined in claim 22 wherein each of said pair of lower arm means and each of said pair of lower leg means are substantially identical to each other.

24. The arrangement defined in claim 22 and further comprising:

a pair of hand means, each hand means having an upper connecting portion detachably mounted in said wrist portion of one of said lower arm means for relative movement therebetween;

a pair of foot means, each foot means having an upper connecting portion detachably mounted in said ankle portion of one of said lower leg means for relative movement therebetween.

25. In an articulated doll of the type having a head means, arm means, leg means, a body means, and a neck means interconnecting said head means to said body means, a shoulder means interconnecting said arm means to said body means and hip means interconnecting said leg means to said body means, the improvement comprising, in combination:

said body means comprising:

means for detachably securing said neck means to said body means including an upper portion, and said neck means and said shoulder means movably mounted on said upper portion of said body means, and said upper portion of said body means having neck walls defining a neck aperture;

another portion of said body means having a substantially planar surface spaced a preselected distance from said neck walls and in opposition thereto;

and said neck means comprising:

a lower knob portion frictionally engaging and movably clamped between said neck walls of said upper body portion of said body means and said planar surface of said body means for nutational movement of said neck means in said body means; and said body means further comprising:

a lower portion coupled to said another portion, and said hip means movably mounted on said lower portion of said body means.

26. The arrangement defined in claim 25 wherein said shoulder means and said hip means are detachably mounted on said body means.

27. The arrangement defined in claim 26 wherein:

said body means further comprises:

said lower portion of said body means being detachably coupled to said another portion of said body means.

28. The arrangement defined in claim 27 wherein:

said another portion of said body means further comprises at least one intermediate body portion detachably coupled to said upper portion of said body means, and said lower portion of said body means detachably coupled to said at least one intermediate portion.

* * * * *